US010081028B2

(12) United States Patent
Ki

(10) Patent No.: US 10,081,028 B2
(45) Date of Patent: Sep. 25, 2018

(54) ECO-PUMP TYPE COSMETIC CONTAINER

(71) Applicant: MINJIN Co., Ltd., Hwaseong-si (KR)

(72) Inventor: Keun Seo Ki, Suwon-si (KR)

(73) Assignee: MINJIN CO., LTD., Hwaseong-si (KR)

( * ) Notice: Subject to any disclaimer, the term of this patent is extended or adjusted under 35 U.S.C. 154(b) by 0 days.

(21) Appl. No.: 15/570,422

(22) PCT Filed: May 28, 2015

(86) PCT No.: PCT/KR2015/005340
§ 371 (c)(1),
(2) Date: Oct. 30, 2017

(87) PCT Pub. No.: WO2016/182112
PCT Pub. Date: Nov. 17, 2016

(65) Prior Publication Data

US 2018/0147588 A1 May 31, 2018

(30) Foreign Application Priority Data

May 12, 2015 (KR) ..... 10-2015-0065997

(51) Int. Cl.
*B05B 11/00* (2006.01)
*A45D 34/00* (2006.01)
*B65D 47/00* (2006.01)

(52) U.S. Cl.
CPC ..... *B05B 11/3033* (2013.01); *A45D 34/00* (2013.01); *B05B 11/3046* (2013.01);
(Continued)

(58) Field of Classification Search
CPC .. A45D 34/00; A45D 2200/054; B65D 47/00; B05B 11/3033; B05B 11/3046; B05B 11/3052
See application file for complete search history.

(56) References Cited

U.S. PATENT DOCUMENTS 5,351,862 A * 10/1994 Weag ..... B05B 11/0048 222/145.3
5,462,208 A * 10/1995 Stahley ..... B05B 7/0037 222/190

(Continued)

FOREIGN PATENT DOCUMENTS

KR 10-2010-0128968 12/2010
KR 10-1146999 5/2012

(Continued)

*Primary Examiner* — Paul R Durand
*Assistant Examiner* — Randall Gruby
(74) *Attorney, Agent, or Firm* — Lex IP Meister, PLLC

(57) ABSTRACT

The present invention relates to an eco-pump type cosmetic container, and more particularly, to an eco-pump type cosmetic container having a shoulder portion and a shoulder bush, which are integrally formed and used, thereby preventing the shoulder bush from being separated from the shoulder portion, maximizing a pumping effect so that a space between the shoulder portion and the shoulder bush is completely sealed, and easily opening a seat portion by supporting the upper end of the shoulder bush to be in close contact with the seat portion, which is formed on an elastic member.

3 Claims, 5 Drawing Sheets

(52) U.S. Cl.
CPC ..... *B05B 11/3052* (2013.01); *B65D 47/00* (2013.01); *A45D 2200/054* (2013.01)

(56) References Cited

U.S. PATENT DOCUMENTS

| | | | | | |
|---|---|---|---|---|---|
| 5,544,789 | A * | 8/1996 | Gillingham | B05B 11/3033 | 222/153.13 |
| 5,664,703 | A * | 9/1997 | Reifenberger | B05B 11/0016 | 222/207 |
| 7,025,233 | B2 * | 4/2006 | Masuda | B05B 11/3035 | 222/207 |
| 8,240,516 | B2 * | 8/2012 | Lautre | B05B 11/0029 | 222/153.13 |
| 2004/0094578 | A1 * | 5/2004 | Bougamont | B05B 11/0064 | 222/209 |
| 2010/0116849 | A1 * | 5/2010 | Lautre | B05B 11/0029 | 222/153.13 |
| 2010/0200616 | A1 * | 8/2010 | Decottignies | B05B 11/007 | 222/207 |
| 2012/0024904 | A1 * | 2/2012 | Doulin | B05B 11/3035 | 222/207 |
| 2014/0103071 | A1 * | 4/2014 | Park | A45D 34/00 | 222/207 |
| 2018/0002073 | A1 * | 1/2018 | Huang | B65D 41/005 | |

FOREIGN PATENT DOCUMENTS

| | | |
|---|---|---|
| KR | 20-2012-0008410 | 12/2012 |
| KR | 10-1438144 | 9/2014 |
| KR | 10-1447558 | 10/2014 |

* cited by examiner

[FIG. 1]
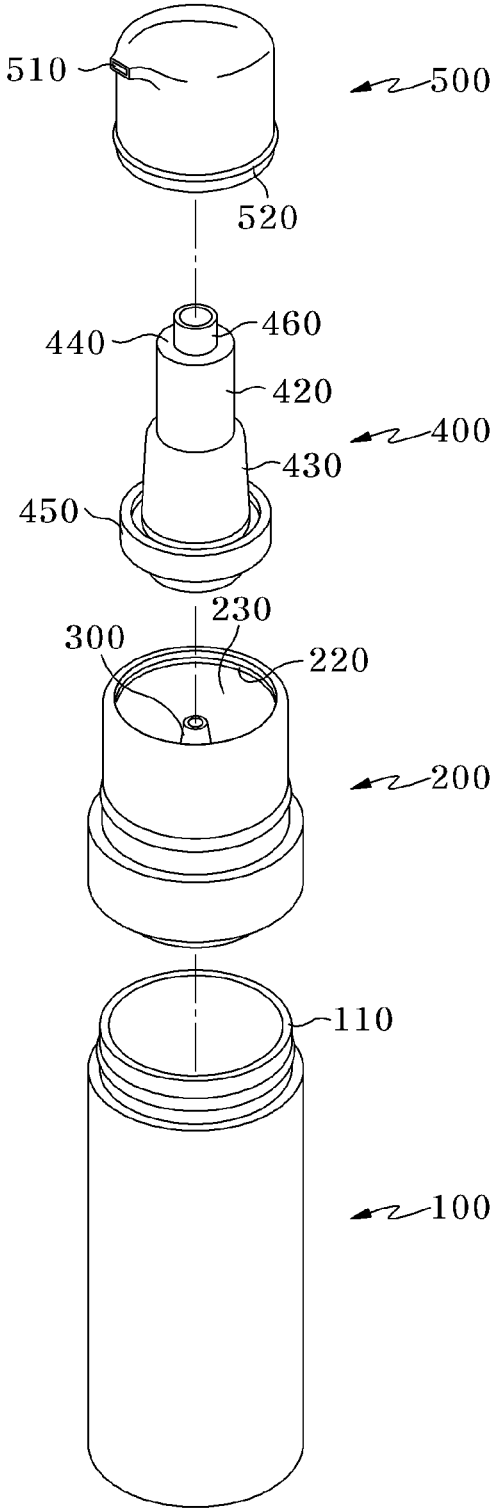

[FIG. 2]
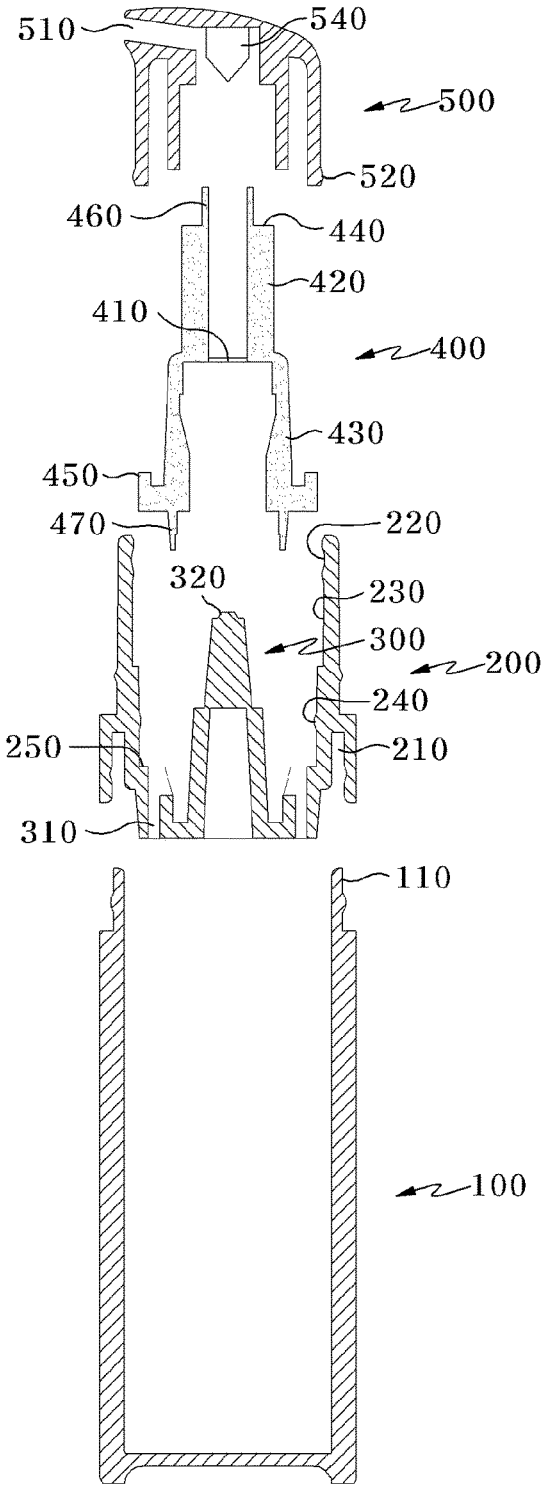

[FIG. 3]
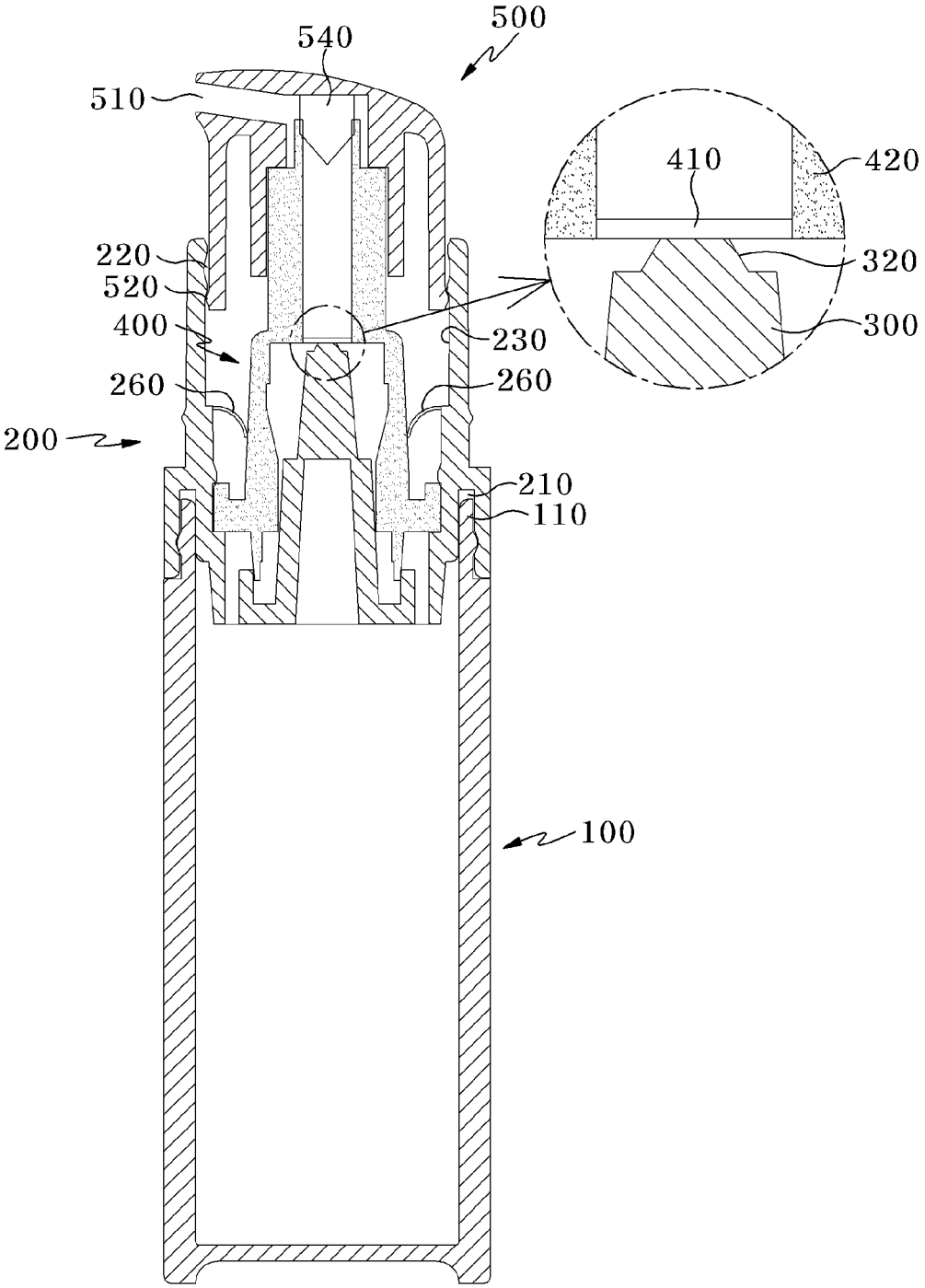

[FIG. 4]
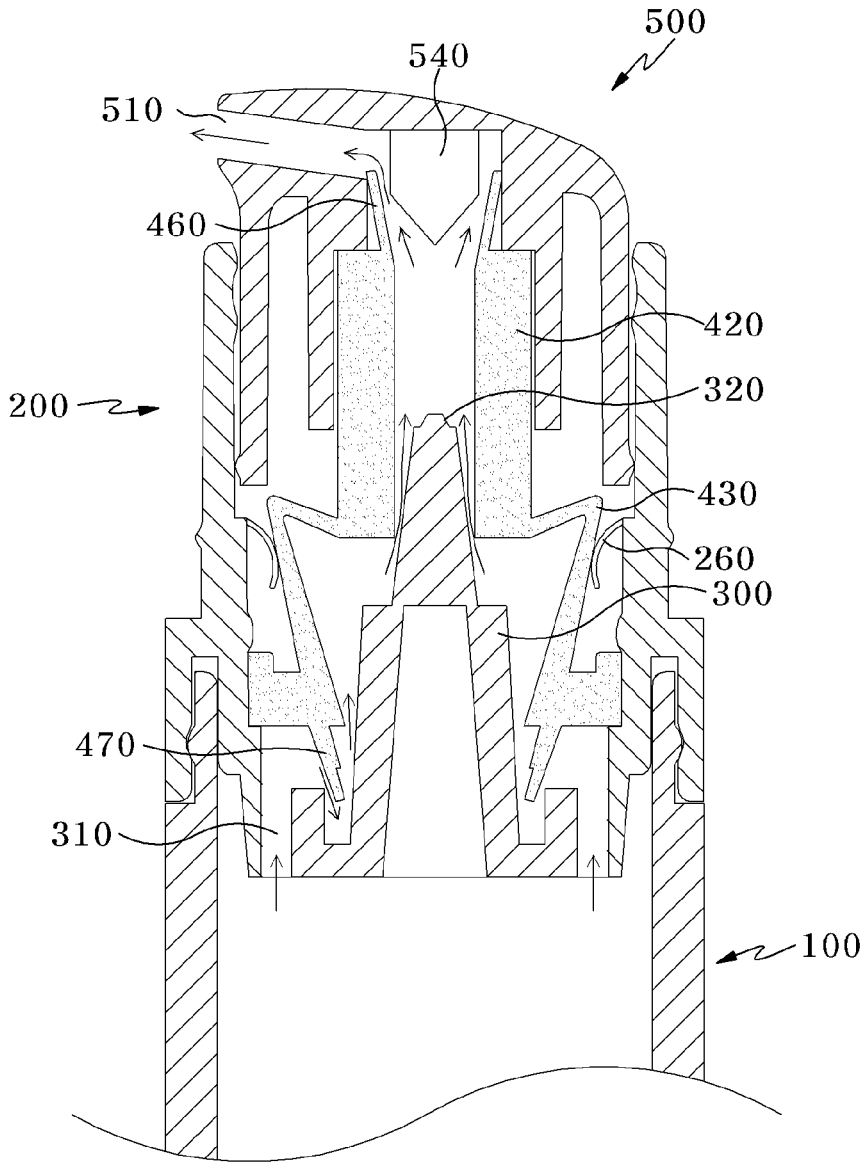

[FIG. 5]
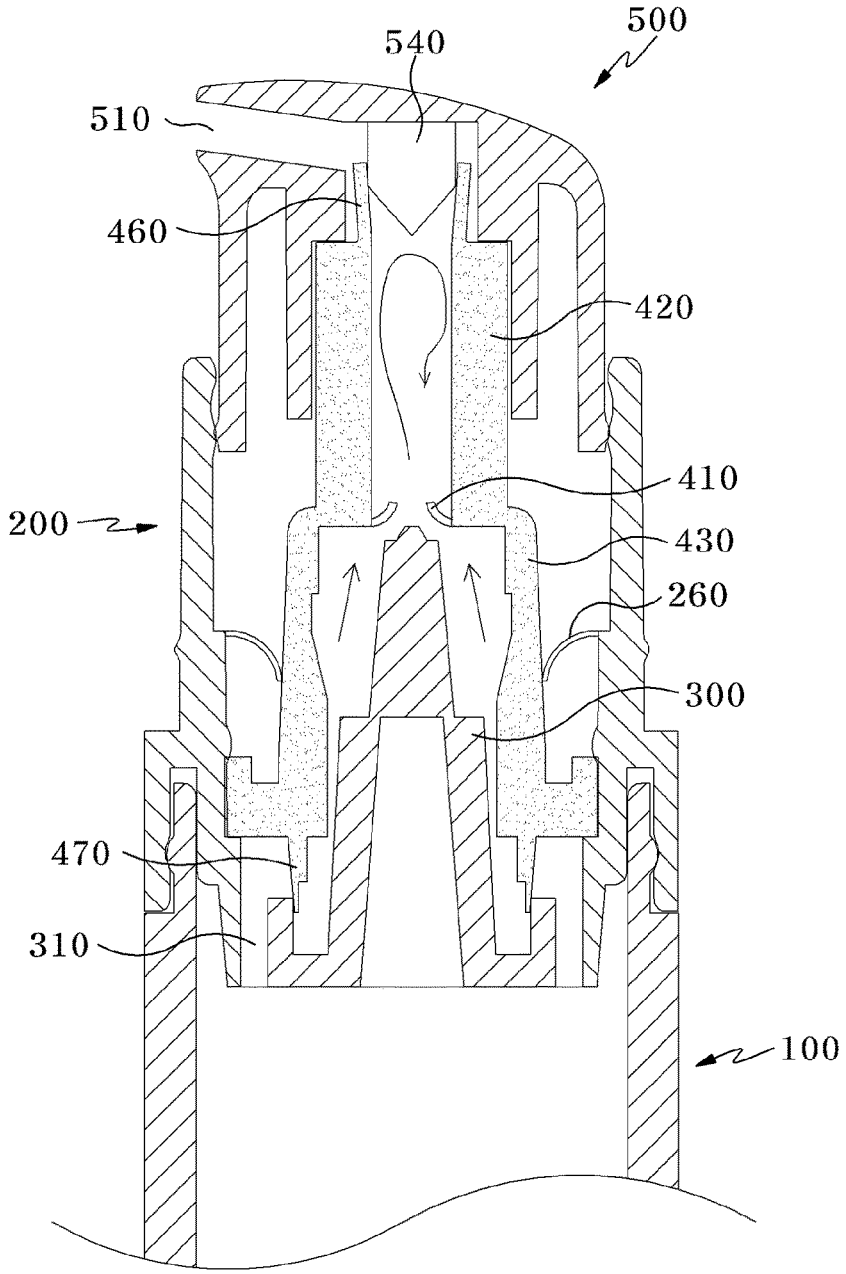

ECO-PUMP TYPE COSMETIC CONTAINER

TECHNICAL FIELD

The present invention relates to an eco-pump type cosmetic container, and more particularly, to an eco-pump type cosmetic container having a shoulder portion and a shoulder bush, which are integrally formed and used, thereby preventing the shoulder bush from being separated from the shoulder portion, maximizing a pumping effect so that a space between the shoulder portion and the shoulder bush is completely sealed, and easily opening a seat portion by supporting the upper end of the shoulder bush to be in close contact with the seat portion, which is formed on an elastic member.

BACKGROUND ART

Cosmetics are largely formed in powder and liquid forms having various particular densities and viscosities depending on intended use thereof.

Therefore, containers containing these cosmetics are also manufactured in various shapes and structures in consideration of the physical properties of the contents of the cosmetics.

Herein, a pressurized pump is applied to the upper portion of most of containers containing the liquid cosmetics in recent years.

The cosmetic container to which the pressurizing pump is applied may be used by sucking a predetermined amount of liquid cosmetic contained in the cosmetic container by a user's pressurizing operation and then discharging the liquid cosmetic to the outside.

However, such a conventional pressurized pumping device can supply a predetermined amount of cosmetic in the container to the user every time, but since the structure is very complicated, manufacturing production is not easy, and there is a problem in that the economic burden of both a producer and a consumer is increased due to rise in costs.

PRIOR ART DOCUMENT

Patent Document (Patent Document 1) Korean Utility Model Publication No. 20-2015-0000173 (published on Jan. 14, 2015)

(Patent Document 2) Korean Patent Registration No. 10-0918856 (issued on Sep. 17, 2009)

(Patent Document 3) Korean Utility Model Publication No. 20-2014-0002333 (published on Apr. 24, 2014)

(Patent Document 4) Korean Patent Registration No. 10-1287363 (issued on Jul. 12, 2013)

DISCLOSURE

Technical Problem

The present invention is directed to provide an eco-pump type cosmetic container having a shoulder portion and a shoulder bush, which are integrally formed and used, thereby preventing the shoulder bush from being separated from the shoulder portion, maximizing a pumping effect so that a space between the shoulder portion and the shoulder bush is completely sealed, and easily opening a seat portion by supporting the upper end of the shoulder bush to be in close contact with the seat portion, which is formed on an elastic member.

The objects of the present invention are not limited to the aforementioned objects, and other objects, which are not mentioned above, will be apparent to a person having ordinary skill in the art from the following description.

Technical Solution

One aspect of the present invention provides an eco-pump type cosmetic container including: a container having a liquid cosmetic stored therein; a shoulder portion, which is fastened and fixed to the upper portion of the container and has a shoulder bush integrally formed at the center of the interior thereof so as to protrude upwards; an elastic member, which is fastened and fixed inside the shoulder portion, is made of a silicone rubber material having an elastic restoration force, and has a sheet at the center thereof so as to be in close contact with the top surface of the shoulder bush; and a pressing portion which is installed and fixed on the upper portion of the elastic member to pressurize the elastic member, in which the shoulder portion has a guide surface along which the pressing portion is guided and moved, a double engaging projection which is fitted and fixed to a fixing protrusion formed on the pressing portion to be prevented from being separated to the outside, a fitting groove formed so that a connection projection of the container is inserted and fixed therein, a separation preventing protrusion formed on the lower portion of the guide surface so as to prevent the elastic member from being separated upwards, and a discharge hole formed to penetrate from the bottom surface thereof to the upper portion thereof so that the liquid cosmetic, which is stored in the container, is discharged to the outside.

The shoulder portion may further include a support portion which is fixed onto the inner surface in an annular shape, is in close contact with the outer surface of the elastic member, and supports the elastic member deformed by the pressing portion.

The shoulder bush may include a cutting portion which is formed so that an upper end is narrowed and a lower end is gradually widened, disposed in close contact with the sheet, and cuts the sheet by the operation of the pressing portion.

The elastic member may be formed of 0.2 to 1 part by weight of an antibacterial ceramic composition in which 40 to 80 parts by weight of silicon oxide, 20 to 50 parts by weight of aluminum oxide and 1 to 10 parts by weight of silver are mixed with respect to 100 parts by weight of a silicone resin, and the silicon resin may be formed of 40 parts by weight of an ethylene vinyl acetate resin, 19 parts by weight of a polyolefin resin, 18 parts by weight of an ethylene-propylene copolymer rubber, 3 parts by weight of bromo butyl rubber, 5 parts by weight of calcium carbonate, 1 part by weight of zinc oxide, 0.65 part by weight of stearic acid, 3 parts by weight of white spindle oil, 1 part by weight of a cross-linking agent, 0.04 part by weight of a vulcanization accelerator and 0.65 part by weight of a blowing agent.

The details of other exemplary embodiments are included in the following detailed description and the accompanying drawings.

Advantageous Effects

According to the present invention, the eco-pump type cosmetic container has a shoulder portion and a shoulder bush, which are integrally formed and used, thereby preventing the shoulder bush from being separated from the shoulder portion, maximizing a pumping effect so that a space between the shoulder portion and the shoulder bush is completely sealed, and easily opening a seat portion by supporting the upper end of the shoulder bush to be in close contact with the seat portion, which is formed on an elastic member.

Further, the eco-pump type cosmetic container is an eco-friendly product and has an advantage of not requiring separate collection because a metallic material is not present therein.

It will be sufficiently appreciated that the various exemplary embodiments of the present invention can provide various effects which are not specifically mentioned.

DESCRIPTION OF DRAWINGS

FIG. 1 is a diagram illustrating an exploded perspective view of an eco-pump type cosmetic container according to the present invention.

FIG. 2 is a diagram illustrating an exploded cross-sectional view of the eco-pump type cosmetic container according to the present invention.

FIG. 3 is a diagram illustrating a coupled cross-sectional view of the eco-pump type cosmetic container according to the present invention.

FIGS. 4 and 5 are diagrams illustrating operating states of the eco-pump type cosmetic container according to the present invention.

MODES OF THE INVENTION

Various advantages and features of the present invention and methods accomplishing thereof will become apparent from the following description of exemplary embodiments with reference to the accompanying drawings. As those skilled in the art would realize, the described exemplary embodiments may be modified in various different ways, all without departing from the spirit or scope of the present invention. On the contrary, exemplary embodiments introduced herein are provided to make disclosed contents thorough and complete and sufficiently transfer the spirit of the present invention to those skilled in the art. In the drawings, the thickness of layers, and regions are exaggerated for clarity.

Terms, such as first, second, and the like may be used to describe various components and the components should not be limited by the terms. The terms are used to only distinguish one component from another component. For example, a first component may be referred to as a second component, and similarly, the second component may be referred to as the first component without departing from the scope of the present invention.

Terms of an upper end, a lower end, an upper surface, a lower surface, an upper portion, a lower portion, and the like are used for distinguishing relative locations in the components. For example, for convenience, when an upper side on the drawing is referred to as the upper portion and a lower side on the drawing is referred to as the lower portion, in practice, the upper portion may be referred to as the lower portion and the lower portion may be referred to as the upper portion without departing from the scope of the present invention.

Terms used in the present application are used only to describe specific embodiments, and are not intended to limit the present invention. Singular expressions used herein include plurals expressions unless they have definitely opposite meanings. In the present application, it should be understood that term "include" or "have" indicates that a feature, a number, a step, an operation, a component, a part or the combination thereof described in the specification is present, but does not exclude a possibility of presence or addition of one or more other features, numbers, steps, operations, components, parts or combinations thereof, in advance.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined here.

Hereinafter, a preferred exemplary embodiment of an eco-pump type cosmetic container according to the present invention will be described in more detail with reference to the accompanying drawings.

FIG. 1 is a diagram illustrating an exploded perspective view of an eco-pump type cosmetic container according to the present invention, FIG. 2 is a diagram illustrating an exploded cross-sectional view of the eco-pump type cosmetic container according to the present invention, FIG. 3 is a diagram illustrating a coupled cross-sectional view of the eco-pump type cosmetic container according to the present invention, and FIGS. 4 and 5 are diagrams illustrating operating states of the eco-pump type cosmetic container according to the present invention.

First, referring to FIGS. 1 to 5, an eco-pump type cosmetic container according to the present invention may include a container 100, a shoulder portion 200, an elastic member 400, and a pressing portion 500.

The container 100 is formed in a circular or polygonal shape, a connection projection 110 is formed on the opened upper portion thereof, and a space portion storing a liquid cosmetic may be formed therein.

The shoulder portion 200 may have a fitting groove 210 which is fitted and fixed to the connection projection 110 formed in the container 100, a double engaging projection 220 formed at the inner upper portion of the space portion, a guide surface 230 formed on the lower portion of the double engaging projection 220 so that the pressing portion 500 ascends and descends, and a separation prevention protrusion 240 and a mounting projection 250 formed on the lower portion of the guide surface 230 so that the elastic member 400 is fixed and supported.

The separation prevention protrusion 240 fixes a fitting projection 450 formed on the elastic member 400, closely fixes the bottom surface of the elastic member 400 to the mounting projection 250, and may prevent the elastic member 400 frequently deformed by the operation of the pressing portion 500 from being separated upward.

Further, the shoulder portion 200 may include a discharge hole 310 formed to penetrate from the bottom surface to the upper portion thereof so that the liquid cosmetic which is stored in the container is discharged to the outside and a support portion 260 formed on the guide surface 230 to protrude inwards.

At least one discharge hole 310 may be formed on the bottom surface of the shoulder portion 200 in a circumferential direction. Meanwhile, in the normal state, a blocking portion 470 formed in the elastic member 400 blocks the inlet of the discharge hole 310, and when the pressing portion 500 is operated, the blocking portion 470 is opened by the pressure generated therein so that the liquid cosmetic stored in the container 100 is discharged to the outside.

The support portion 260 has one end attached and fixed on the guide surface 230, is formed in an annular shape along a circumferential direction of the guide surface 230, and has the other side which is in close contact with the outer surface of the elastic member 400. The support portion 260 is made of a material having elastic restoration force and may be provided for supporting the outer surface of the elastic member 400 deformed by the pressing portion 500. That is, when a user presses the pressing portion 500 with an excessive force, the elastic member 400 is extremely deformed so that the deformed part may be broken or torn to form a hole. The support portion 260 may be installed at the excessively deformed part to prevent the elastic member 400 from being excessively deformed.

Meanwhile, the shoulder portion 200 may further include a shoulder bush 300 which is integrally formed at the center thereof.

The shoulder bush 300 may be formed in a conical shape in which the lower side is wide and the upper side is gradually narrowed. Further, the shoulder bush 300 may include a cutting portion 320 which is installed and fixed to the upper end.

The cutting portion 320 is formed in a shape in which the upper end is narrow and the lower end is gradually widened and located to be in close contact with a sheet 410 provided on the elastic member 400, and cuts the sheet 410 by the operation of the pressing portion 500. That is, when the user presses the pressing portion 500, the elastic member 400 is deformed while moving downward, and the sheet 410 is torn by the cutting portion 320 by the deformation of the elastic member 400.

The elastic member 400 is formed in a hollow cylindrical shape so that the liquid cosmetic moving through the discharge hole 310 is discharged into a discharge port 510 formed in the pressing portion 500 and the sheet 410 may be formed in middle of the penetration portion to separate upper and lower spaces from each other.

Further, the elastic member 400 may be divided into a maintenance portion 420 that maintains the shape of the upper portion based on the sheet 410 and a variable portion 430 that is deformed by the operation of the pressing portion 500. The elastic member 400 may have pressing projections 440 formed on upper and lower outer sides and a fitting projection 450 which is fitted and fixed between the separation prevention protrusion 240 and the mounting projection 250. A fixing portion 460 may be formed so that the upper portion of the elastic member 400 may be fixed and supported to the pressing portion 500. That is, when the user often presses and operates the pressing portion 500, the upper portion of the elastic member 400 moves downwards to prevent the pressing portion 500 and the elastic member 400 from being separated from each other by the deformation of the variable portion 430.

On the other hand, the elastic member 400 may be formed by adding and mixing 0.2 to 1 part by weight of an antibacterial ceramic composition mixed at a ratio of 40 to 80 parts by weight of silicon oxide, 20 to 50 parts by weight of aluminum oxide and 1 to 10 parts by weight of silver with 100 parts by weight of a silicone resin and then injecting the mixture.

Silicon oxide, aluminum oxide, and silver mixed with the silicon resin are appropriately mixed and used to have sterilization and antibacterial activity and prevent microorganisms from being proliferated by the deformation of the liquid cosmetic.

The silicon resin may be formed of 40 parts by weight of an ethylene vinyl acetate resin, 19 parts by weight of a polyolefin resin, 18 parts by weight of an ethylene propylene copolymer rubber, 3 parts by weight of a bromo butyl rubber, 5 parts by weight of calcium carbonate, 1 part by weight of zinc oxide, 0.65 part by weight of stearic acid, 3 parts by weight of white spindle oil, 1 part by weight of a cross-linking agent, 0.04 part by weight of a vulcanization accelerator and 0.65 part by weight of a blowing agent.

The ethylene-vinyl acetate (EVA) resin has improved toughness, plasticity, and impact resistance as the molecular weight is increased and may compensate for weak defects in temperature change in injection blow molding.

The polyolefin resin is collectively referred to as a homopolymer or a copolymer with double olefins obtained by polymerizing a chained hydrocarbon having one double bond as a monomer, and generally have a small specific gravity, excellent chemical resistance and water resistance, excellent electrical properties, the lightest weight in plastics, and excellent transparency.

The ethylene-propylene copolymer rubber has excellent ozone resistance which is resistance to ozone cracking in vulcanized rubber, very good tensile strength, and excellent chemical resistance and electrical insulation.

The bromo butyl rubber has low gas permeability, high hysteresis, good ozone resistance, and excellent weather resistance.

The calcium carbonate ($CaCO_3$) is used as a neutralizer to reduce the generation of toxic gases harmful to the human body during vulcanization promotion, cross-linking and bubble generation and may improve impact resistance, dimensional stability, smoothness, abrasion resistance, surface activity, and workability.

The zinc oxide (ZnO) is used as a facilitating activator to allow different polymers to chemically react smoothly with each other.

The stearic acid pulverizes agglomerated particles agglomerated with large particles in the process of chemical reaction to form smaller particles and colloidal particles, prevents agglomeration of the formed microparticles, and is used as an aggregate or dispersant in rubber or plastics as a white lobular crystalline mass.

The white spindle oil may prevent the shape sticking to an injection mold during injection blow molding and smoothly draw the molded sole from the injection mold.

The cross-linking agent is used for giving chemical stability such as hardness or resilience to the resin.

The vulcanization accelerator is used for improving the quality of rubber products.

The blowing agent is also called an inflating agent or a foaming agent and is a material which forms bubbles during polymer reaction by mixing rubber or resin.

The pressing portion 500 may have an discharge port 510 which guides the liquid cosmetic moving through the elastic member 400 to be discharged to the outside, a fixing protrusion 520 which is fitted and connected to the double engaging projection 220, a connection space portion 530 which is formed in a tapered shape at the center of the inside thereof to communicate with the discharge port 510 and inserted with the upper portion of the elastic member 400, and a cap 540 which is formed at the upper portion of the connection space portion 530 and inserted to the inner portion of the variable portion 430 to prevent the liquid cosmetic from being discharged to the outside.

Hereinafter, the operation of the eco-pump type cosmetic container according to the present invention will be described in more detail with reference to the accompanying drawings.

When the user presses the upper surface of the pressing portion 500 downward, the pressing portion 500 moves downward along the guide surface 230.

When the pressing portion 500 moves along the guide surface 230, the maintenance portion 420 of the elastic member 400 moves downward while maintaining an appearance, and when the maintenance portion 420 moves downward, the variable portion 430 is deformed by the force thereof. Herein, the sheet 410 formed on the elastic member 400 is torn and opened by the cutting portion 320.

As such, the inside of the elastic member 400 deformed by the pressing portion 500 is reduced to generate an internal inflation pressure, the blocking portion 470 moves inward by the internal inflation pressure to open the discharge hole 310, the fixing portion 460 is divided to both sides so as to be separated from the outer surface of the cap 540 to be opened, and then the liquid cosmetic stored in the container 100 is discharged to the outside through the discharge port 510.

In addition, when the pressing force of the pressing portion 500 is removed, the deformed variable portion 430 is formed in the initial state again while moving upward by the elastic force. At this time, the fixing portion 460 divided to both sides is in close contact with the outer circumference of the cap 540 again to seal the discharge port 510, and the blocking portion 470 blocks the discharge hole 310 to be sealed.

Although exemplary embodiments of the present invention were described above with reference to the accompanying drawings, those skilled in the art would understand that the present invention may be implemented in various ways without changing the necessary features or the spirit of the prevent invention. Therefore, it should be appreciated that the aforementioned exemplary embodiments are all illustrative in all aspects and are not restricted.

EXPLANATION OF REFERENCE NUMERALS AND SYMBOLS

100: Container
110: Connection projection
200: Shoulder portion
210: Fitting groove
220: Double engaging projection
230: Guide surface
240: Separation preventing protrusion
250: Mounting projection
260: Support portion
300: Shoulder bush
310: Discharge hole
320: Cutting portion
400: Elastic member
410: Sheet
420: Maintenance portion
430: Variable portion
440: Pressing projection
450: Fitting projection
460: Fixing portion
470: Blocking portion
500: Pressing portion
510: Discharge port
520: Fixing protrusion
530: Connection space portion
540: Cap

The invention claimed is:

1. An eco-pump type cosmetic container, comprising:

a container having a liquid cosmetic stored therein;

a shoulder portion which is fastened to an upper portion of the container and has a shoulder bush integrally formed at a center of the interior thereof so as to protrude upwards;

an elastic member, which is fastened and fixed inside a shoulder portion, is made of a silicone rubber material having an elastic restoration force, and has a sheet at the center thereof so as to be in close contact with a top surface of the shoulder bush; and a pressing portion which is installed and fixed on an upper portion of the elastic member to pressurize the elastic member, wherein the shoulder portion has a guide surface along which the pressing portion is guided and moved, a double engaging projection which is fitted and fixed to a fixing protrusion formed on the pressing portion to be prevented from being separated to the outside, a fitting groove formed so that a connection projection of the container is inserted and fixed therein, a separation preventing protrusion formed on the lower portion of the guide surface so as to prevent the elastic member from being separated upwards, and a discharge hole formed to penetrate from the bottom surface to the upper portion thereof so that the liquid cosmetic, which is stored in the container, is discharged to the outside, wherein the shoulder portion further includes a support portion which is fixed onto an inner surface wherein the support portion is in an annular shape, is in close contact with an outer surface of the elastic member, and supports the elastic member deformed by the pressing portion wherein the support portion deforms as the elastic member deforms.

2. The eco-pump type cosmetic container of claim 1, wherein the shoulder bush includes a cutting portion which is formed so that an upper end is narrowed and a lower end is gradually widened, disposed in close contact with the sheet, and cuts the sheet by the operation of the pressing portion.

3. The eco-pump type cosmetic container of claim 1, wherein the elastic member is formed of 0.2 to 1 part by weight of an antibacterial ceramic composition in which 40 to 80 parts by weight of silicon oxide, 20 to 50 parts by weight of aluminum oxide and 1 to 10 parts by weight of silver are mixed with respect to 100 parts by weight of a silicone resin, and the silicon resin is formed of 40 parts by weight of an ethylene vinyl acetate resin, 19 parts by weight of a polyolefin resin, 18 parts by weight of an ethylene propylene copolymer rubber, 3 parts by weight of bromo butyl rubber, 5 parts by weight of calcium carbonate, 1 part by weight of zinc oxide, 0.65 part by weight of stearic acid, 3 parts by weight of white spindle oil, 1 part by weight of a cross-linking agent, 0.04 part by weight of a vulcanization accelerator and 0.65 part by weight of a blowing agent.

* * * * *